United States Patent [19]

Raasch et al.

[11] Patent Number: 4,496,110

[45] Date of Patent: Jan. 29, 1985

[54] DOUBLE-SIDED TEXTILE MACHINE

[75] Inventors: Hans Raasch; Hans Grecksch; Klaus Bock, all of Monchen-Gladbach, Fed. Rep. of Germany

[73] Assignee: W. Schlafhorst & Co., Monchen-Gladbach, Fed. Rep. of Germany

[21] Appl. No.: 590,015

[22] Filed: Mar. 15, 1984

[51] Int. Cl.[3] ..... B65H 54/20; B65H 67/04

[52] U.S. Cl. ..... 242/35.5 A; 198/457; 198/611

[58] Field of Search ..... 242/35.5 A, 35.5 R, 242/35.6 R; 198/457, 580, 611, 339

[56] References Cited

U.S. PATENT DOCUMENTS

| | | | |
|---|---|---|---|
| 1,489,926 | 4/1924 | Burtchaell | 198/457 X |
| 1,872,006 | 8/1932 | Regan | 198/457 |
| 1,905,025 | 4/1933 | Allen | 198/580 X |
| 2,306,871 | 12/1942 | Esser et al. | 242/35.6 R |
| 3,184,030 | 5/1965 | Ludwig | 198/580 X |
| 3,303,918 | 2/1967 | Larson | 198/611 X |
| 3,575,276 | 4/1971 | Rupert | 198/457 X |
| 3,690,443 | 9/1972 | Snyder | 198/457 |

FOREIGN PATENT DOCUMENTS

| | | | |
|---|---|---|---|
| 0026160 | 4/1981 | European Pat. Off. | 242/35.5 A |
| 2816418 | 10/1979 | Fed. Rep. of Germany | 242/35.5 A |

*Primary Examiner*—Stanley N. Gilreath

*Attorney, Agent, or Firm*—Herbert L. Lerner; Laurence A. Greenberg

[57] ABSTRACT

A double-sided textile machine, includes a plurality of spool assemblies for producing cross wound bobbins, a spool collecting station at an end of the machine, a first spool transport belt disposed at one side of the machine for receiving cross wound bobbins from at least one of the spool assemblies and for transporting the bobbins toward the spool collecting station in a given transporting direction with the bobbins axially aligned in the given transporting direction, a second spool transport belt disposed at the other side of the machine for receiving cross wound bobbins from at least one of the spool assemblies and for transporting the bobbins in a direction opposite the given transporting direction, and a device for successively receiving the cross wound bobbins from the second spool transport belt, for turning the bobbins through substantially 180° and for transferring the bobbins to the first spool transport belt.

10 Claims, 3 Drawing Figures

DOUBLE-SIDED TEXTILE MACHINE

The invention relates to a double-sided textile machine, such as an open-end spinning machine, a winding machine or a two-for-one twister or double twisting machine, having a plurality of spool assemblies for producing cross wound bobbins or cheeses, and a device for collecting and conveying the bobbins.

Until the present, cross wound bobbins or cheeses that had been produced were taken off the machine either manually or by machine, without considering the spatial orientation of the cross wound bobbin during its manufacture. When subsequently processing the cross wound bobbins, difficulties arose because it is not easy to visually detect whether a cylindrical cross wound bobbin carries an S-twist winding or a Z-twist winding. During the subsequent overhead withdrawal of the thread, difficulties and errors can occur for this reason when surface patterns are produced, because some of the cross wound bobbins may have been mounted the wrong way on the frame, and are thus withdrawn overhead with the wrong twist.

It has been concluded that these difficulties could only be overcome, if such a mixup of the original winding positions and a disregard of the sense of the winding was prevented at the doublesided textile machine which produces the cross wound bobbins.

It is accordingly an object of the invention to provide a double-sided textile machine, which overcomes the hereinafore-mentioned disadvantages of the heretofore-known devices of this general type, and to deliver the cross wound bobbins produced at both sides of the textile machine to a particular station in an orderly manner, maintaining the original winding position and winding sense, and have them ready at the station for further processing.

With the foregoing and other objects in view there is provided, in accordance with the invention, a double-sided textile machine, such as an open-end spinning machine, a winding machine or a two-for-one twister or double twisting machine, comprising a plurality of spool assemblies for producing cross wound bobbins or cheeses, a spool collecting station at an end of the machine, a first spool transport belt disposed at one side of the machine for receiving cross wound bobbins from at least one of the spool assemblies and for transporting the bobbins toward the spool collecting station in a given transporting direction with the bobbins axially aligned in the given transporting direction, a second spool transport belt disposed at the other side of the machine for receiving cross wound bobbins from at least one of the spool assemblies and for transporting the bobbins in a direction opposite the given transporting direction, and a device for successively receiving the cross wound bobbins from the second spool transport belt, for turning the bobbins through substantially 180° and for transferring the bobbins to the first spool transport belt.

It is practical to provide the spool collecting station at the head or end of the textile machine which best permits a trouble-free further transport of the bobbins produced. The invention ensures that a cross wound bobbin which is oriented axially in the transporting direction at any spooling assembly maintains this orientation during the transport. The spools can be deposited manually or automatically onto the spool transport belts. A completely automatic deposition of the spools is preferable. The spool transport belts can run continuously, although they may also stand still at times, receive bobbins and run intermittently to conduct the received cross wound bobbins to the spool collecting station.

In accordance with another feature of the invention, the device for receiving, turning and transferring the bobbins includes a turntable having an axis of rotation disposed in a plane passing between the first and second transport belts, and spool guiding surfaces partially surrounding the turntable in a semicircular shape. For example, such a turntable can rotate just above the spool transport belts. However, it can also be placed in such a way that it is located just above the transport belt carrying the approaching bobbins and just below the transport belt carrying the leaving bobbins, i.e. the transport belt which runs toward the spool collecting station. The distance between the spool guiding surfaces should be dimensioned narrow enough to provide a reliable axial guide for the cross wound bobbins.

In accordance with a further feature of the invention, the device for receiving, turning and transferring the bobbins includes a roller conveyor having conical rollers disposed in vicinity of or at the end of the transport belts at another end of the machine opposite or facing away from the spool collecting station. Conical rollers are better suited than cylindrical rollers for this purpose because the turning circle of conical rollers is usually very small.

In accordance with an added feature of the invention, there is provided a common drive for the first and second transport belts and preferably for the device for receiving, turning and transferring the bobbins. A common drive has the advantage of facilitating a properly adjusted synchronization of all of the rotating parts. Additionally, only a single driver is required, such as a geared down motor. The decision as to whether or not a turntable or a roller conveyor requires its own driver, depends on the individual situation. Through a suitable placement of a turntable and a roller conveyor, the deposited bobbins can set the turntable or rollers in motion by their own weight.

In accordance with an additional feature of the invention, there is provided a drive roller connected to the common drive for driving the first transport belt, and a gearing drive driven by the first transport belt for driving the second transport belt. It is practical to position the drive motor and the gear set at opposite ends of the spool transport belts. This provides the possibility of directly or indirectly driving the spool transport belts from their respective forward ends.

In accordance with again another feature of the invention, the gearing drive is a bevel gearing drive having first, second and third meshing bevel gears, and including a deflection roller connected to the first bevel gear at an end of the first belt at another end of the machine opposite the spool collecting station for driving the first directly driven transport belt, and a drive roller connected to the third bevel gear for driving the second transport belt. This structure guarantees the interdependent drive and the opposing running directions of the spool transport belts, in a simple manner. If the turning device is also to be driven, in accordance with a concomitant feature of the invention, there is provided a shaft driving and carrying the turntable, and another set of two meshing bevel gears, one of the two bevel gears of the set being driven by the second bevel gear of the bevel gearing drive, and the other of the two bevel gears of the set driving the shaft.

Other features which are considered as characteristic for the invention are set forth in the appended claims.

Although the invention is illustrated and described herein as embodied in a double-sided textile machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
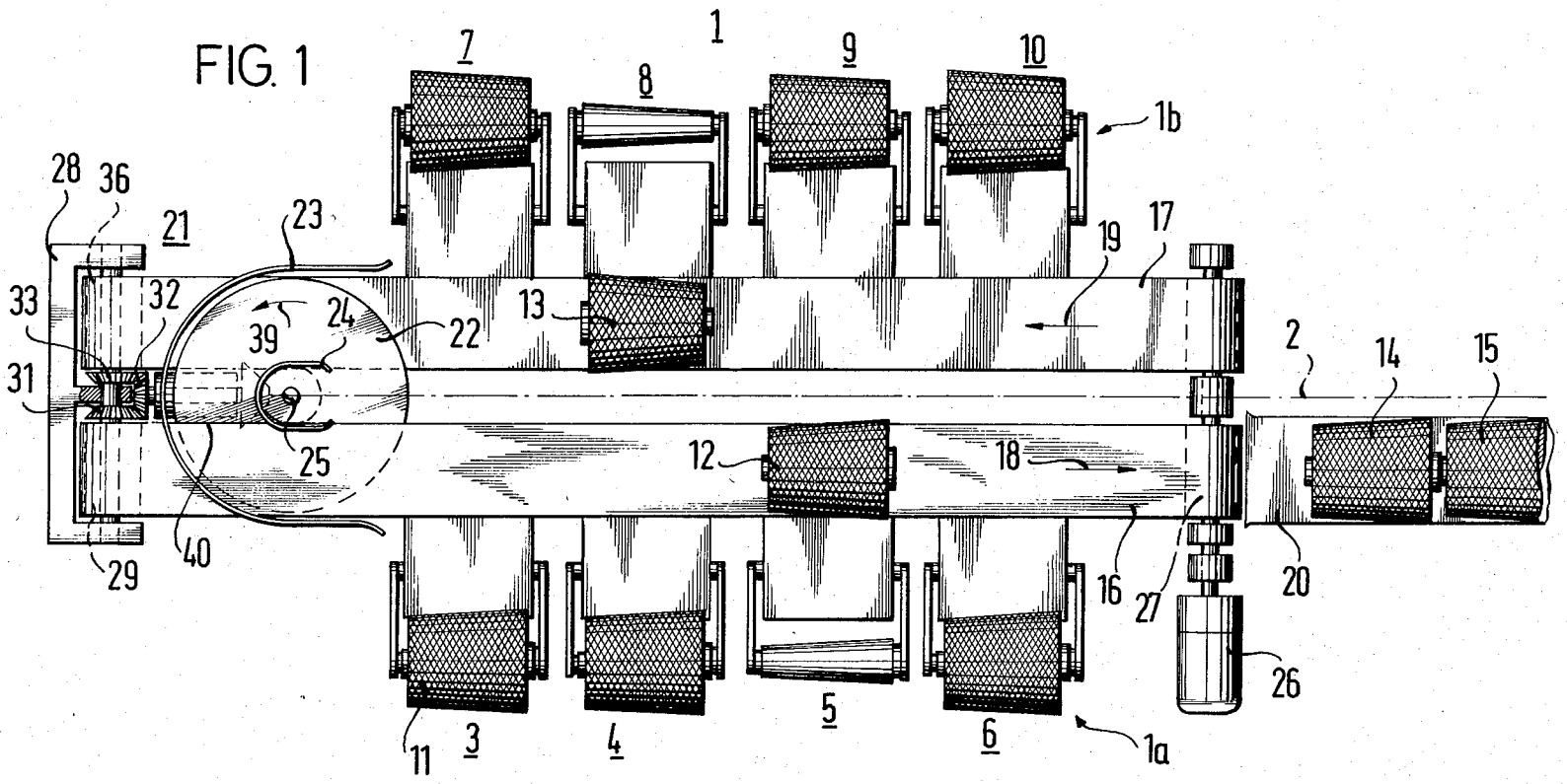
FIG. 1 is a fragmentary, diagrammatic top-plan view of a double-sided textile machine according to the invention.

Referring now to the figures of the drawing in detail and first particularly to FIG. 1 thereof, there is seen a double-sided textile machine 1 in the form of an open-end spinning machine. The open-end spinning machine 1 is formed of machine sides or sections 1*a* and 1*b*. The plane separating the two machine sides is designated with reference numeral 2. In FIG. 1, spool assemblies 3 to 6 are shown at the machine side 1*a*, and spool assemblies 7 to 10 are shown at the machine side 1*b*. As is also shown, conical cross wound bobbins or cheeses are already wound at the spool assemblies 3, 4, 6, 7, 9 and 10. A cross wound bobbin shown in the spool assembly 3 is designated with reference numeral 11 and is typical of all of the other conical cross wound bobbins. A cross wound bobbin 12 of the spool assembly 5 has already been deposited on a spool transport belt 16 in axial alignment with the transporting direction. The transporting direction is indicated by an arrow 18. The spool transport belt 16 ends at a spool collecting position 20 which has already received two conical cross wound bobbins 14 and 15. The spool assembly 8 has deposited its conical cross wound bobbin 13 onto a spool transport belt 17, having a transporting direction indicated by an arrow 19. It can thus be seen that the two spool transport belts run in opposite directions.

At the left end or head of the textile machine 1 is a device 21 provided for the sequential removal of the cross wound bobbins 13 from the spool transport belt 17, for turning the bobbins 13 through 180°, and for transferring the bobbins onto the other spool transport belt 16 which moves toward the spool collection position 20. This device 21 includes a turntable 22 which is surrounded in a semi-circular manner by spool guiding surfaces 23, 24, and an axis of rotation 25 which runs between the two transport belts 16 and 17.

The two spool transport belts 16, 17 and the device 21 have a common drive unit 26. This drive unit 26 is in the form of a geared drive motor. The spool transport belt 16 has a drive roller 27 at the end thereof which is connected to the drive unit 26. The other spool transport belt 17 is driven by a gear drive 28 which is disposed at the head or opposite end of the textile machine 1 from the drive roller 27, and the gear drive 28 itself is driven by a deflection roller 29 which is driven by the first spool transport belt 16. FIG. 1 shows that the deflection roller 29 is connected to a first bevel gear 31 of the drive 28 which is constructed in the form of a bevel gear drive. The bevel gear 31 engages a second bevel gear 32. The second bevel gear 32 in turn engages a third bevel gear 33 which is connected to a drive roller 36. This drive roller 36 drives the spool transport belt 17.

Figure 2:
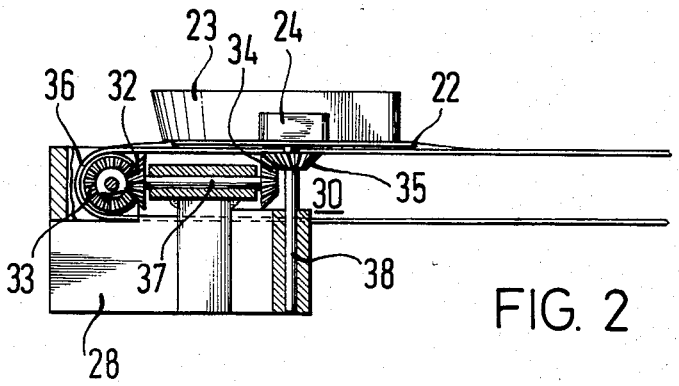
FIG. 2 is a partly cross-sectional side view showing details of a turntable.

The intermediate bevel gear 32 of the bevel gearing drive 28 is supported on a shaft 37 which drives a first bevel gear 34 of a bevel gear set 30, as seen in FIG. 2. A second bevel gear 35 of the bevel gear set 30 is connected to a vertical shaft 38 which carries the turntable 22.

When the drive unit 26 is set in operation, the two spool transport belts 16, 17 run in the transporting directions indicated by the arrows 18, 19. The turntable 22 simultaneously rotates in the direction of a curved arrow 39. All of the conical cross wound bobbins deposited on the spool transport belts are transported in direction toward the spool collecting position 20 with the wider cone end pointing forward. For example, the conical cross wound bobbin 13 arrives at the rotating turntable 22, is picked up by the turntable and is conducted in the direction of the arrow 39. The turntable 22 is constructed in such a way as to be very flat, and rotates just slightly above the transport belt 17. In contract to this, the upper surface of the spool transport belt 16 is guided slightly above the turntable 22, so that the transfer of the cross wound bobbins from the turntable onto the spool transport belt 16 occurs at a defined transfer edge 40.

The cross wound bobbins deposited on both spool transport belts are either continuously transported to the spool collecting station 20, or the belts may only serve as a temporary intermeidate storage place. For example, an intermediate storage function of the spool transport belts is advantageous if the spool collecting station 20 is used discontinuously. The spool collecting station 20 may be a movable spool storage device. The spool transport belts can be constructed in such a way that they are controlled by the spool collecting station 20. Furthermore, the automatic deposition of bobbins onto the spool transport belts can be blocked while the spool transport belts are running. This is intended for a discontinuous operation, in which the transport belts can be completely emptied rapidly.

Figure 3:
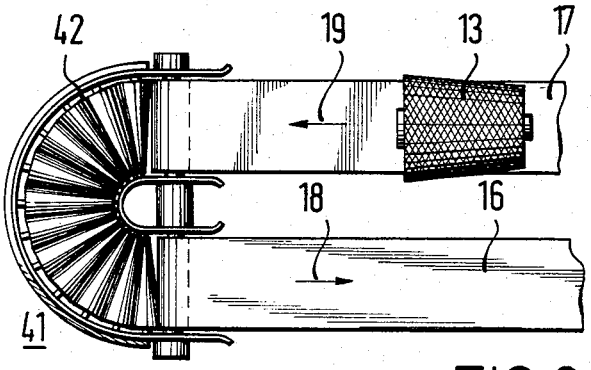
FIG. 3 is a fragmentary top-plan view showing details of a roller conveyor.

The alternate construction according to the embodiment of FIG. 3, includes a device which is designated as a whole with reference numeral 41, and serves for sequentially transferring the cross wound bobbins from the transport belt 17, for turning the bobbins through 180°, and for transferring them onto the spool transport belt 16, which moves toward the spool collecting station. The device 41 is formed of conically shaped rollers 42 which are disposed in a semi-circle forming a roller-conveyor.

We claim:

1. Double-sided textile machine, comprising a plurality of spool assemblies for producing cross wound bobbins, a spool collecting station at an end of the machine, a first spool transport belt disposed at one side of the machine for receiving cross wound bobbins from at least one of said spool assemblies and for transporting the bobbins toward said spool collecting station in a given transporting direction with the bobbins axially aligned in said given transporting direction, a second spool transport belt disposed at the other side of the machine for receiving cross wound bobbins from at least one of said spool assemblies and for transporting the bobbins in a direction opposite said given transporting direction, and a device for successively receiving the cross wound bobbins from said second spool transport belt, for turning the bobbins through substantially 180° and for transferring the bobbins to said first spool transport belt.

2. Double-sided textile machine according to claim 1, wherein said device for receiving, turning and transferring the bobbins includes a turntable having an axis of rotation disposed in a plane passing between said first and second transport belts, and spool guiding surfaces partially surrounding said turntable in a semi-circular shape.

3. Double-sided textile machine according to claim 1, wherein said device for receiving, turning and transferring the bobbins includes a roller conveyor having conical rollers disposed in vicinity of said transport belts at another end of the machine opposite said spool collecting station.

4. Double-sided textile machine according to claim 1, including a common drive for said first and second transport belts.

5. Double-sided textile machine according to claim 4, wherein said common drive also drives said device for receiving, turning and transferring the bobbins.

6. Double-sided textile machine according to claim 4, including a drive roller connected to said common drive for driving said first transport belt, and a gearing drive driven by said first transport belt for driving said second transport belt.

7. Double-sided textile machine according to claim 5, including a drive roller connected to said common drive for driving said first transport belt, and a gearing drive driven by said first transport belt for driving said second transport belt.

8. Double-sided textile machine according to claim 6, wherein said gearing drive is a bevel gearing drive having first, second and third meshing bevel gears, and including a deflection roller connected to said first bevel gear at another end of the machine opposite said spool collecting station for driving said first transport belt, and a drive roller connected to said third bevel gear for driving said second transport belt.

9. Double-sided textile machine according to claim 7, wherein said gearing drive is a bevel gearing drive having first, second and third meshing bevel gears, and including a deflection roller connected to said first bevel gear at another end of the machine opposite said spool collecting station for driving said first transport belt, and a drive roller connected to said third bevel gear for driving said second transport belt.

10. Double-sided textile machine according to claim 9, including a shaft driving said turntable, and another set of two meshing bevel gears, one of said two bevel gears of said set being driven by said second bevel gear of said bevel gearing drive, and the other of said two bevel gears of said set driving said shaft.

* * * * *